US006935850B2

(12) United States Patent
Huang et al.

(10) Patent No.: US 6,935,850 B2
(45) Date of Patent: Aug. 30, 2005

(54) AXIALLY ALIGNED DUAL PISTON CYLINDER AIR PUMP WITH A COMMON HEAD PORTION

(76) Inventors: Ying-Che Huang, No. 111, Lane Tzeng-Fu, Tzeng-Tsuo Tsuen, Shiou-Shuei Shiang, Chang-hua Hsien (TW); Chun-Ming Huang, No. 111, Lane Tzeng-Fu, Tzeng-Tsuo Tsuen, Shiou-Shuei Shiang, Chang-hua Hsien (TW)

( * ) Notice: Subject to any disclaimer, the term of this patent is extended or adjusted under 35 U.S.C. 154(b) by 279 days.

(21) Appl. No.: 10/438,104

(22) Filed: May 15, 2003

(65) Prior Publication Data

US 2004/0228750 A1 Nov. 18, 2004

(51) Int. Cl.[7] ..... F04B 1/12

(52) U.S. Cl. ..... 417/524; 417/521; 417/530; 417/531; 417/553; 280/201; 137/513.5

(58) Field of Search ..... 417/521, 524, 417/530, 531, 553; 280/201; 137/513.5, 516.25

(56) References Cited

U.S. PATENT DOCUMENTS

| | | | | | |
|---|---|---|---|---|---|
| 90,718 | A | * | 6/1869 | Appel | 417/529 |
| 1,392,928 | A | * | 10/1921 | Foss | 417/533 |
| 4,334,839 | A | * | 6/1982 | Flagg | 417/536 |
| 5,253,668 | A | * | 10/1993 | Mills | 137/12 |
| 5,295,506 | A | * | 3/1994 | Smith | 137/271 |
| 5,683,234 | A | * | 11/1997 | Chuang et al. | 417/531 |
| 6,050,791 | A | * | 4/2000 | Wu | 417/521 |
| 6,135,733 | A | * | 10/2000 | Wu | 417/467 |
| 6,350,112 | B1 | * | 2/2002 | Huang et al. | 417/521 |
| 6,447,259 | B2 | * | 9/2002 | Elliott-Moore | 417/225 |
| 6,676,390 | B2 | * | 1/2004 | Wang | 417/528 |
| 6,739,842 | B2 | * | 5/2004 | Wu | 417/63 |

* cited by examiner

*Primary Examiner*—Cheryl Tyler
*Assistant Examiner*—Emmanuel Sayoc
(74) *Attorney, Agent, or Firm*—Browdy and Neimark, P.L.L.C.

(57) ABSTRACT

A dual-direction pump includes two cylinders arranged on opposite sides of a head portion and an inlet return-flow prevention device and a leakproof device mounted between the cylinder and the head portion for avoiding leakage at the juncture between the cylinder and the head portion or leakage induced by reverse flow in one of the cylinders in the case of a single-sided pumping operation in the other cylinder. The head portion has an outlet port to which an outlet return-flow prevention device is mounted. A knob is rotatably mounted to the outlet pot and a nut is fixed to the knob for selectively engaging an inflation valve to avert detachment. The outlet return-flow prevention device prevents reverse or return flow induced in the outlet port in order to reduce resistance caused thereby and enhances pumping efficiency.

5 Claims, 5 Drawing Sheets

AXIALLY ALIGNED DUAL PISTON CYLINDER AIR PUMP WITH A COMMON HEAD PORTION

BACKGROUND OF THE INVENTION

1. Field of the Invention

The present invention relates to a pump for inflating a bicycle tire or ball, and more particularly to a pump capable of preventing reverse airflow or air leakage.

2. The Prior Arts

U.S. Pat. No. 6,350,112 discloses a dual-direction pump comprising a head portion composed of two cylinders arranged on opposite sides of the head portion, and a connector mounted to the head portion for releasable connection with a valve of tire for inflation.

Since conventionally, the inflation connector is coupled to the head portion in a non-secured manner, it is liable to come off because of vibration or due to reasons whatsoever during inflating. Moreover, as there is no return-flow prevention device available in the head portion, both cylinders have to work simultaneously in order to prevent air from leaking through the other side.

SUMMARY OF THE INVENTION

A primary object of the present invention is to provide a dual-direction pump for eliminating the drawbacks of leakage through the other side during an inflation process.

Another object of the present invention is to provide a dual-direction pump for eliminating the problem of easy detachment of the coupling between the head portion and the inflation valve.

In order to realize the objects, a feature of the present invention comprises a return-flow prevention device, such as a check valve, mounted in each cylinder to avoid reverse flow and thus leakage of air in an inflation process.

A second feature of the present invention comprises a nut-carried knob at an outlet end of the pump so as to avoid potential detachment of the head portion from an inflation valve.

Basing on above concepts, two pumping cylinders are arranged on two opposite sides respectively at the head portion of pump, and an inlet return-flow prevention device as well as a leakproof device is mounted between each cylinder and the inlet of the head portion for avoiding leakage at the juncture between the cylinder and the head portion or through the other cylinder side in the case of single-side pumping operation. Also, the outlet end of the head portion is provided with an outlet return-flow prevention device and a knob. The knob is combined with a nut for releasably and effectively attaching to an inflation valve to avert detachment. The outlet return-flow prevention device prevents a reverse or return flow so as to reduce resistance caused thereby and enhances pumping efficiency.

The merits of the present invention is summarized as follows:

1. Compared with the prior arts, the present invention effectively eliminates leakage air on the other side when single-side inflation is performed.

2. The head portion of the air pump is securely attached to the inflation valve of for example a tire when the tire is inflated and undesired detachment of the pump from the tire is eliminated.

For more detailed information regarding advantages or features of the present invention, at least an example of preferred embodiment will be described below with reference to the annexed drawings.

BRIEF DESCRIPTION OF THE DRAWINGS

The related drawings in connection with the detailed description of the present invention to be made later are described briefly as follows, in which.

DETAILED DESCRIPTION OF THE PREFERRED EMBODIMENT

Figure 1:
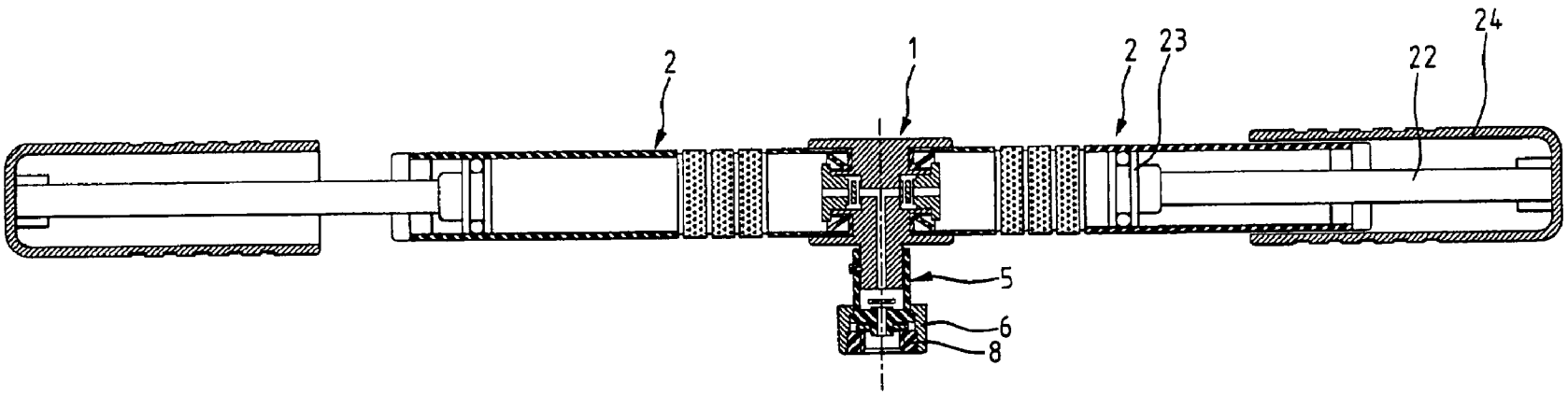
FIG. 1 is a cross-sectional view of a dual-direction pump constructed in accordance with the present invention.

With reference to the drawings and in particular to FIG. 1, a dual-direction pump constructed in accordance with the present invention comprises a head portion 1 having two inlets to each of which a cylinder 2 is mounted. In the embodiment illustrated, the inlets are arranged on opposite sides of the head portion 1 whereby the cylinders 2 are opposite to each other. Each cylinder 2 comprises a rod 22 drivingly coupled to a piston 23 movable in the cylinder 2. A handgrip 24 is mounted to a free end of the rod 22 for manually and axially moving the piston 23 by the rod 22. Air is the cylinder 2 is thus compressed and forced into the head portion 1.

Figure 2:
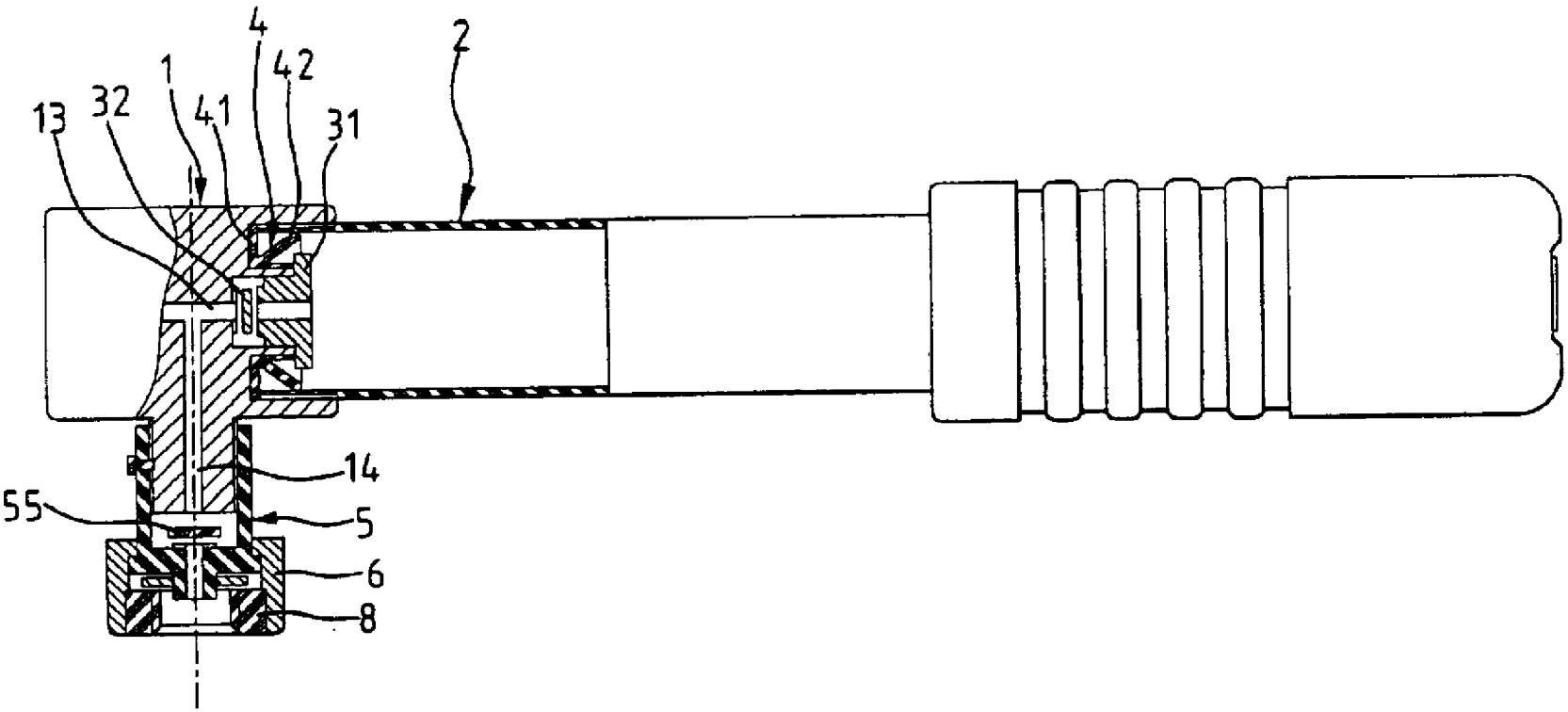
FIG. 2 is a side elevational view of a portion of the dual-direction pump showing one of the cylinders and the head portion thereof.
Figure 3:
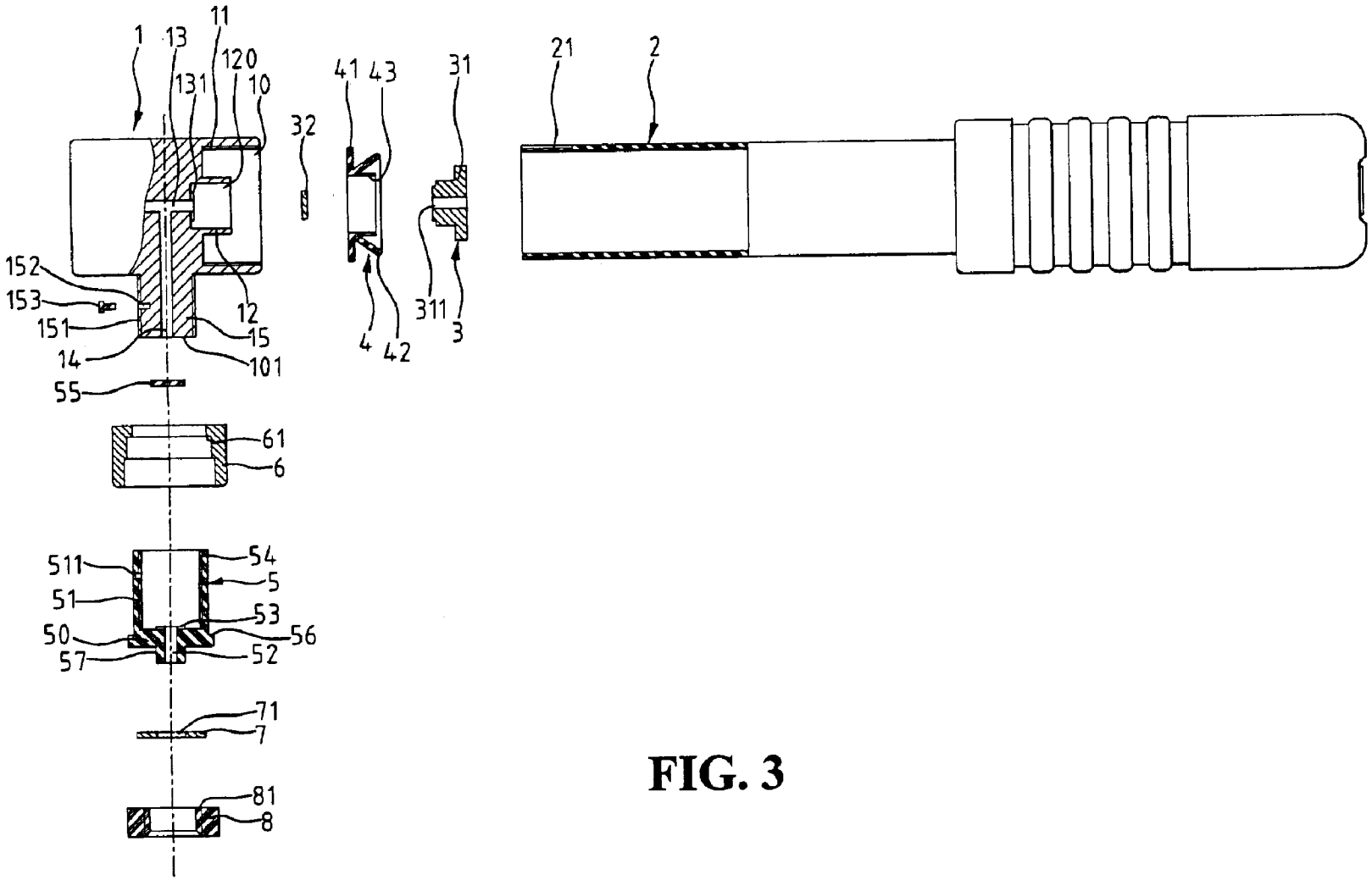
FIG. 3 is an exploded view of FIG. 2.

Also referring to FIGS. 2 and 3, the head portion 1 has two inlet ports 10 to which the cylinders 2 are respectively mounted. An inner threading 11 is formed on an inner wall (not labeled) of the inlet portion for engaging an outer threading 21 formed on an outside surface (not label) of the cylinder 2 thereby releasably attaching the cylinder 2 to the inlet port 10 of the head portion 1. An inlet duct 12 is defined inside and in a center of the inlet port 10. An inlet channel 13 is defined in the head portion 1 and is in communication with and extends from a bottom of the inlet duct 12 to an outlet channel 14. A plurality of radially extending grooves 131 is formed in the bottom of the inlet duct 12 around and in communication with the inlet channel 13.

The head portion 1 has an outlet port 15 forming an external threading 151. The outlet port 15 has an end face 101 from which the outlet channel 14 extends through the outlet port 15 to the inlet channel 13. An inner-threaded hole 152 is defined in the outlet port 15 for receivingly engaging a bolt 153.

An inlet return-flow prevention device 3 and a leakproof device 4 are disposed between the cylinder 2 and the head portion 1. T inlet return-flow prevention device 3 prevents a reverse airflow in the head portion 1 so as to ensure no leakage happens on the other side when air is pumped at one side. The leakproof device 4 prevents leakage of air, especially under pressure, out of the cylinder 2 through interface between the cylinder 2 and the head portion 1.

The inlet return-flow prevention device 3 is comprised of an inlet valve seat 31 and a valve piece 32. The inlet valve seat 31 is fit into the inlet duct 12 and spaced from the bottom of the inlet duct 12. The valve piece 32 is made of rubber material or similar materials and movably received in the inlet duct 12. The inlet valve seat 31 defines a bore 311 extending therethrough, providing a fluid communication between inside and outside the inlet duct 12. The valve piece 32 is movable between the bottom of the inlet duct 12 and an end face of the valve seat 31. When the valve piece 32 reaches the end face of the valve seat 31, the valve piece 32 blocks the bore 311 and cutting off airflow therethrough. When the valve piece 32 moves to the bottom of the inlet duct 12, the valve piece 32 blocks the inlet channel 13 but not the radially extending grooves 131 whereby air is allowed to flow between the inlet duct 12 and the inlet channel 13 via the radially extending grooves 131.

The leakproof device 4 which is formed with a rubber material has a tubular flange 43, an annular flange 41 connected to and outward and radially extending from the tubular flange 43, and an inclined flange 42 formed between the tubular flange 43 and the annular flange 41 and extending from a joint therebetween to hence configure the leakproof device 4 as a bowl. The tubular flange 43 is tightly fit over an outer wall of the inlet duct 12, while the annular flange 41 abuts against a bottom face of the inlet port 10. A terminal edge of the inclined flange 42 leans against an inside surface of the cylinder 2 when the cylinder 2 is mounted to the inlet port 10 as shown in FIG. 2. Therefore, air leakage through the joint between the cylinder 2 and the head portion 1 is thoroughly blockaded An outlet return-flow prevention device 5 is coupled to the output port 15 of the head portion 1 for preventing a reverse flow in the output port 15, comprising an outlet valve seat 50 and a valve piece 55. The outlet valve seat 50 comprises a substantially cylindrical body forming an inner space defined by a sidewall having an inner surface thereof with an inner threading 54 formed in the inner surface for engaging the external threading 151 of the out port 15 and thus removably attaching the outlet return-flow prevention device 5 to the outlet port 15. A through hole 511, substantially radial, is defined in the sidewall. The through hole 511 is made alignment with the inner-threaded hole 152 of the outlet port 15 and the bolt 153 extends through the hole 511 and engages the inner-threaded hole 152 to securely fix the outlet return-flow prevention device 5 to the outlet port 15.

An annular flange 56 is formed around the cylindrical body of the outlet return-flow prevention device 5 and adjacent to a lower end thereof. An outlet bore 52 is defined in a bottom of the cylindrical body and in communication with the inner space. A plurality of radially extending grooves 53 is formed on the bottom and surrounding and in fluid communication with the bore 52. The valve piece 55, which is made of a rubber material, is received in the inner space of the valve seat 50 and movable between the end face 101 of the out port 15 and the bottom of the inner space of the valve seat 50. When the valve piece 55 reaches the end face 101 of the out port 15, the valve piece 55 blocks the outlet channel 14 and cutting off airflow therethrough. When the valve piece 55 moves to the bottom of the inner space of the valve seat 50, the valve piece 55 blocks the outlet bore 52 but not the radially extending grooves 53 whereby air is allowed to flow between the inner space of the valve seat 50 and the outlet bore 52 via the radially extending grooves 53.

A knob 6, which is a cylindrical body having a size larger than the outlet valve seat 50, has an inner flange 61 formed at an upper portion thereof and is fit over the valve seat 50 with the flange 61 engaging and supported by the flange 56 of the valve seat 50.

A tubular portion 57 extends from the bottom of the cylindrical body of the outlet valve seat 50 with the bore 52 extending completely therethrough. The outlet valve seat 50 is received in the knob 6 so that an annular space (not labeled) is formed between the knob 6 and the tubular portion 57. A leakproof washer 7 is received in the annular space and fit over the tubular portion 57 and positioned against the bottom of the cylindrical body of the outlet valve seat 50. A nut 8 having inner threading 81 is fit into and fixed to the knob 6, such as by force fitting, whereby the nut 8 is rotatable and movable in unison with the knob 6.

In an inflation operation performed by the dual-direction pump of the present invention, the inner threading 81 of the nut 8 is made engaging with an external threading (not labeled) of for example an inflation valve 9 of a bicycle tire or a ball by manually rotating the knob 6. The piston 23 of either one or both of the cylinders 2 is manually and axially driven by means of the handgrip 24. Air inside the cylinder (s) 2 is compressed and forced through the inlet return-flow prevention device 3, the inlet and outlet channels 13, 14 of the head portion 1, and the outlet return-flow prevention device 5 into the bicycle tire or the ball.

Figure 4:
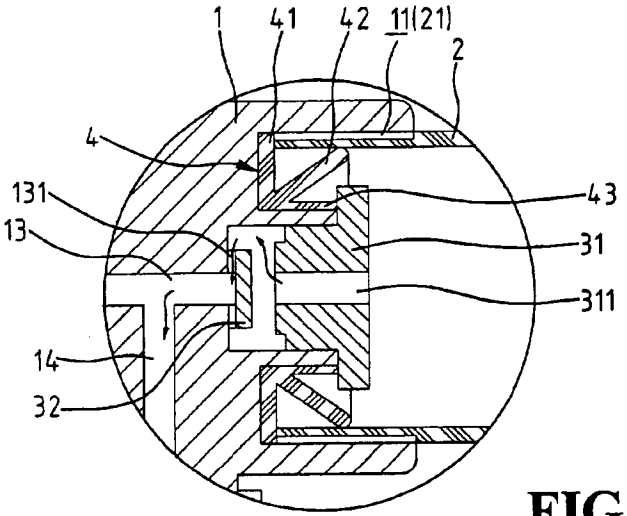
FIG. 4 is a cross-sectional view showing a return-flow prevention device arranged in an inlet between the head portion and the cylinder of the dual-direction pump of the present invention at an open condition.
Figure 5:
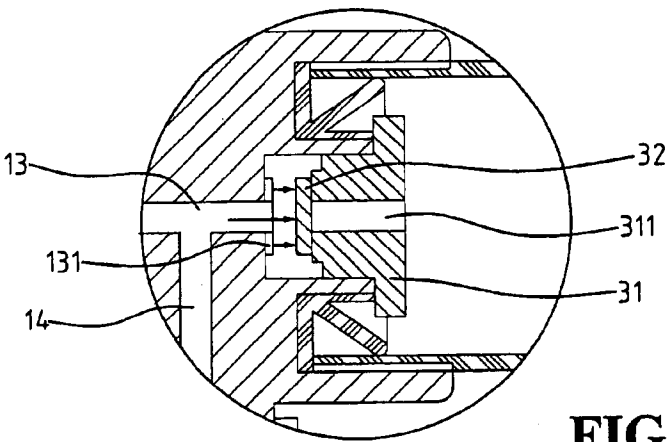
FIG. 5 is similar to FIG. 4 but showing the return-flow prevention device at a closed condition.

FIG. 4 shows that the valve piece 32 of the inlet return-flow prevention device 3 is forced against and thus blocks the entrance of the inlet channel 13 in a pumping operation. However, as indicated by the arrows, air is still allowed to enter the inlet channel 13 through the grooves 131. FIG. 5 shows that when pumping operation is made in only one of the cylinders 2, the air entering the inlet channel 13 is prevented from getting off the head portion 1 through the other cylinder 2 as the bore 311 of the inlet valve seat 31 is blocked by the valve piece 32 that is forced against the valve seat 31 by the compressed air. Thus, air can be properly and effectively pumped toward the outlet port 15 of the heat portion 1 and then entering the inflation valve 9 of the bicycle tire or the ball.

Figure 6:
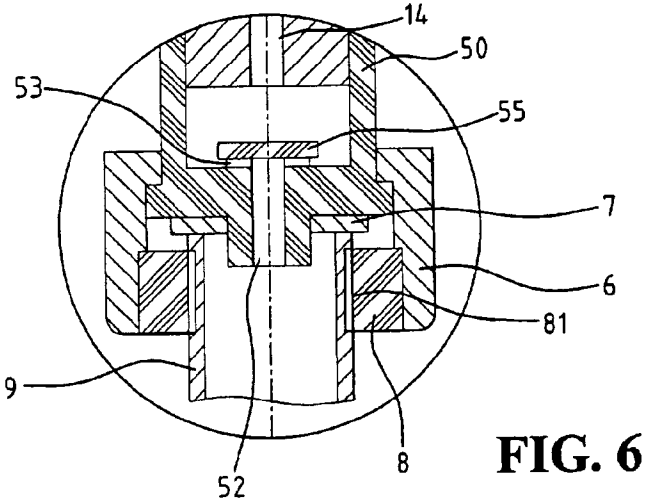
FIG. 6 is a cross-sectional view showing a return-flow prevention device arranged in an outlet end of the head portion of the dual-direction pump of the present invention at an open condition.
Figure 7:
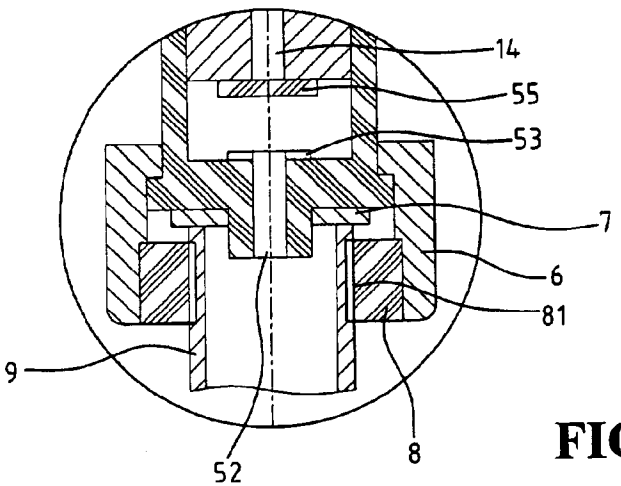
FIG. 7 is similar to FIG. 6 but showing the return-flow prevention device at a closed condition.

FIG. 6 shows that when air is pumped out through the outlet channel 14, the valve piece 55 is moved toward and forced against, by airflow, the bottom of the outlet valve seat 50 and thus blocking the axial entrance of the outlet bore 52. However, air is still permitted to enter the outlet bore 52 via the grooves 53. On the other hand, a reverse airflow induced in the outlet valve seat 50 drives the valve piece 55 toward the end face 101 of the outlet ort 15 and blocking the outlet channel 14 (FIG. 7). This prevents the occurrence of the reverse airflow through the outlet port 15 thereby reducing resistance against pumping operation by the reverse flow. Further, the leakproof washer 7 effectively prevents leakage of compressed air through the juncture between an inflation valve 9 and the nut 8.

In the above described, at least one preferred embodiment has been described in detail with reference to the drawings annexed, and it is apparent that numerous changes or modifications may be made without departing from the true spirit and scope thereof, as set forth in the claims below.

What is claimed is:

1. A dual-direction pump comprising:

a head portion forming two inlet ports to each of which a cylinder is coupled, each inlet forming an inlet duct and an inlet channel in fluid communication with each other, the inlet duct having a bottom in which a plurality of first grooves are defined and in fluid communication with the inlet channel for allowing air to enter the inlet channel therethrough, the head portion forming an outlet port in which an outlet channel is defined and in fluid communication with the inlet channel;

an inlet return-flow prevention device comprising an inlet valve seat mounted to the inlet duct and a valve piece movably received inside the inlet duct and between the bottom of the inlet duct and the inlet valve seat for selectively blocking a bore defined in the inlet valve seat and in fluid communication with both the inlet duct and the cylinder;

a leakproof device received and retained in the inlet port and between the inlet duct and the cylinder;

an outlet return-flow prevention device comprising an outlet valve seat attached to the outlet port of the head portion and forming a space between a bottom of the outlet valve seat and the outlet port and a valve piece received in the space and movable between the bottom of the outlet valve seat and the outlet port to selectively block the outlet channel of the head portion, the outlet valve seat forming an outlet bore in fluid communication with the space and adapted to form fluid communication with an external inflation valve, a plurality of second grooves being formed on the bottom of the outlet valve seat and in fluid communication with the outlet bore for allowing air to enter the bore therethrough; and a knob rotatably mounted to the outlet valve seat and forming threading for selectively and releasably engaging the external inflation valve.

2. The dual-direction pump according to claim 1, wherein the leakproof device has a tubular flange fit over an outside surface of the inlet duct and an inclined flange having a free terminal leaning against a surface of the cylinder.

3. The dual-direction pump according to claim 1, wherein the outlet port forms an external threading and wherein the outlet valve seat having an internal threading engaging the external threading to attach the outlet valve seat to the outlet port.

4. The dual-direction pump according to claim 3, wherein the outlet port defines an inner-threaded hole, the outlet valve seat defining a hole aligned with the inner-threaded hole, a bolt extending through the hole of the outlet valve seat and engaging the inner-threaded hole of the outlet port to securely fix the outlet valve seat to the outlet port.

5. The dual-direction pump according to claim 1, wherein the outlet valve seat forms an external circumferential flange while the knob forms an internal circumferential flange engaging and supported by the external flange to allow for rotation of the knob with respect to the outlet valve seat.

* * * * *